United States Patent [19]

Libby

[11] Patent Number: 4,770,419

[45] Date of Patent: Sep. 13, 1988

[54] BOWLING ALLEY ACCESSORY

[76] Inventor: Roy Libby, 3025 Todd Dr., Madison, Wis. 53713

[21] Appl. No.: 19,746

[22] Filed: Feb. 27, 1987

[51] Int. Cl.[4] ..... A63D 5/00

[52] U.S. Cl. ..... 273/54 R; 272/70.3; 273/DIG. 27

[58] Field of Search ..... 273/54 R, DIG. 27; 272/70, 70 A, 70.3, 70.4; 135/67; 104/118, 120, 121; 414/921

[56] References Cited

U.S. PATENT DOCUMENTS

| | | | |
|---|---|---|---|
| 2,642,074 | 6/1953 | Pedley | 273/70.3 UX |
| 3,548,122 | 12/1970 | Hay | 104/118 |
| 3,583,322 | 6/1971 | Vykukal | 272/70 |
| 3,985,082 | 10/1976 | Barac | 272/70 X |

OTHER PUBLICATIONS

Aids & Appliances, Jul. 1972, p. 5.

*Primary Examiner*—Anton O. Oechsle
*Attorney, Agent, or Firm*—Keith Schoff

[57] ABSTRACT

A portable monorail accessory with traversable carriage for use by blind bowlers to align themselves with a bowling alley in preparing to bowl a ball is described.

6 Claims, 1 Drawing Sheet

BOWLING ALLEY ACCESSORY

BACKGROUND OF INVENTION

1. Field of Art

Bowling alley accessories are used to aid blind persons in aligning themselves on the approach floor of an alley in preparation for delivering a bolwed ball.

2. Prior Art

A waist-high guide rail with weighted standards has been used in bowling alleys for assisting blind bowlers to properly orient themselves in approaching an alley to bowl a ball, the bowler sliding his free hand along the rail during his approach for maintaining proper direction of travel. Such devices are obstacles to free movement about an approach area and are particularly annoying to sighted bowlers. Additionally, they are cumbersome and unweidly to move and to store. U.S. Pat. No. 3,039,771 to Bablouzian provides a rubber mat for being placed on an approach floor which is provided with a series of ridges on its upper serface which deliniate the centerline and lateral edge extensions of an alley. The ridges are perceived by a bowler through tactile sensing with his feet and enable the bowler to align and laterally position himself with respect to an alley. Other devices have been utilized which through electric or elctronic means produce audible tones indicating lateral position of a bowled ball during its progress along an alley, or which sense the number and position of bowling pins knocked down by a bowled ball and transmit such information to a touch-read display which is located at the head-end of an alley or which is hand-held by a bowler.

SUMMARY OF THE INVENTION

A blind bowler's guide accessory is configured as a foldable, lightweight monorail with attached traversable carriage having an upstanding handle which can be gripped by the free hand of a bowler during his approach to delivering a bowled ball to maintain him on proper course and at proper distance behind the foul line. The entire device can be folded into a package about one foot square and three feed long and weighing no more than a bowling ball. The monorail lies on the floor of the approach area of an alley and is easily stepped over by bowlers, creating no obstacle to free movement by persons in the area.

DETAILED DESCRIPTION OF ONE EMBODIMENT OF THE INVENTION

Figure 2:
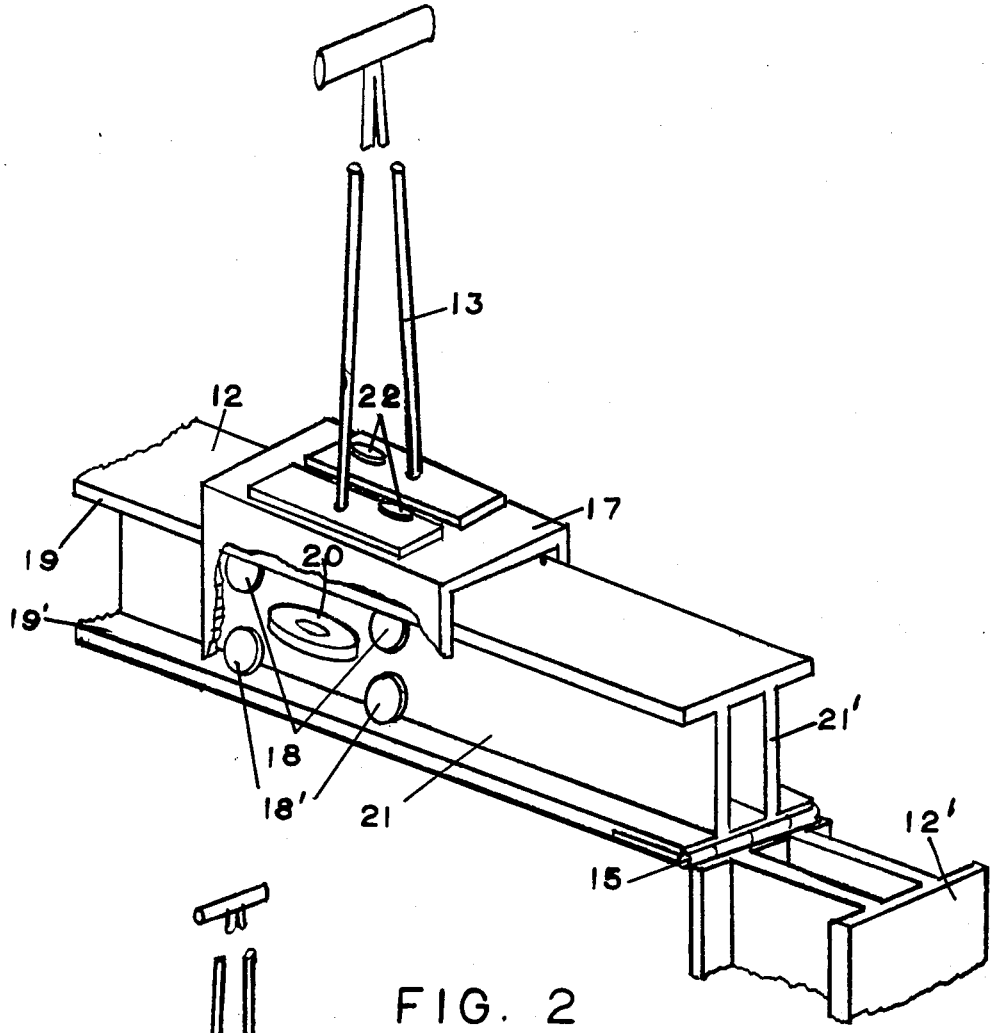
FIG. 2 is a perspective view in partial cutaway section of a carriage portion of the embodiment of FIG. 1 shown with a hinged joint in the monorail in open positon.
Figure 1:
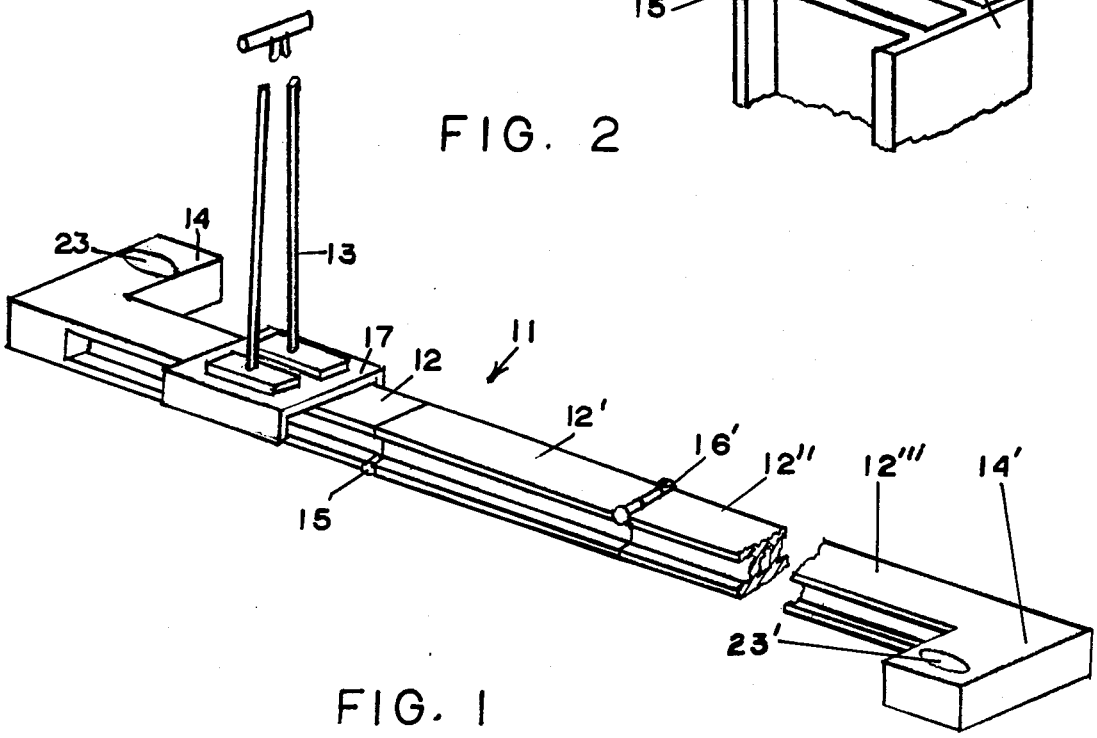
FIG. 1 is a perspective view of an embodiment of a bowling alley accessory for blind bowlers according to this invention.

In FIG. 1, bowling accessory 11 is shown deployed in extended position for use with monorail sections 12, 12', 12'', and 12''' being linearly aligned in end-abutting arrangement and carriage 17 carring fixed handle 13 mounted thereon for being operably traversed along the extended length of the monorail. The several sections of monorail are operably connected by hinges 15, 15', and 16 for being folded with top surfaces of adjoining sections disposed to contact and with bottom sections of adjoining sections similarly being disposed to fold into contacting arrangement. To provide such arrangement, hinges are disposed on opposite top and bottom faces at opposite ends of a monorail section. Four sections of monorail are shown in FIG. 1, however, a greater or lesser number of such sections may be provided as convenient with a total length as extended being preferably about seventeen feet. As shown in FIG. 2, with a bottom-face disposed hinge such as hinge 15 or 15' opened, carriage 17 may be installed or removed from a monorail section, but cannot otherwise be attached or detached in engaging position. In the embodiment shown, horizontal axis, bearing mounted rollers 18, 18' run on the inboard faces of upper flange portion 19, and lower flange portion 19', respectively, of monorail section 12, as shown in FIG. 2, and vertical axis, bearing mounted roller 20 runs on the outboard face of web portion 21 of the monorail section. The laterally opposite extremity of carriage 17 is similarly equipped with a complementary set of bearing mounted rollers to provide an operable mounting for carriage 17 to traverse the length of the extended monorail. Any other operable arrangement of roller means may be provided including grooved trolley rollers which may run on the lateral faces of upper flange portion 19.

Two laterally spaced web portions 21, 21' are shown in FIG. 2 for monorail section 12 for providing rigidity and light weight to the section, but any other operable configuration may be used. The monorail is preferably extruded from suitable synthetic resinous material, e.g. polyolefin, or may comprise metal such as aluminum or fiber reinforced plastic. In a non-preferred embodiment, sliding contact may be made between the monorail and the carriage using low frictional coefficient material such as fluorocarbon for a contact surface.

Handle 13 is configured with a top grip and depending leg portions for being detachable secured to carriage 17 by means of bolts and wing nuts 22, the handle being detached from the carriage for convenience in transport and storage.

Laterally extending feet portions 14, 14' are shown with recesses 23, 23' respectively, provided therein for receiving bowling balls as weighting means. The foot portions may be fixed in position or may be mounted to rotate ninety degrees around the principal axis of the monorail to render the configuration of the apparatus more compact when folded. Alternatively, the lateral extending configuration of the feet may be eliminated with outward folding feet of strap material substituted and the position of recesses 23, 23' moved to the centerline of the monorail. Any other operable configuration which provides stability to the device against sidewise tipping may also be provided.

For use, bowling accessory 11 may be unfolded from a self-contained package about one foot square by three feet and the monorail deployed by being extended along the approach floor to a bowling alley. Before being totally deployed carriage 17 is engaged with the monorail and handle 13 is attached. After being positioned appropriately with respect to lateral placement on the approach and distance from the foul line, the apparatus is weighed by placing two bowling balls in recesses 23, 23' to render it ready for use. In the embodiment shown, it is desirable to reverse the accessory end for end to accomodate a change of right and left handedness of the bowler or bowlers using the accessory. A bowler then positions himself on the approach by gripping the top of handle 13 with his free hand and proceeding to bowl the ball while traversing carriage 17 along the monorail. After delivery of the ball, the carriage is returned to its original position to ready it for further use. With the exception of longitundinally and laterally positioning the accessory on the approach floor with respect to the bowling alley, a blind person may transport, deploy and collapsibly stow the apparatus easily and without assistance. In use, the accessory provides minimal inconvenience to operation of the alley or to bowlers using adjacent alleys.

The accessory of this invention may be altered from that decribed by substitution of sliding contact means for rollers, and alternative shapes for the monorail such as one of hexagonal cross section with as few as four rollers or contact means being provided arranged as two on the top facing surface and one on each of the two surfaces disposed at angles of one hundred twenty degrees from the top facing surface.

Included in the inventive concept herein described, and as a further alternative, flanged or peripherally grooved rollers or sliding means may be provided to reduce the number of interfacing contacts, or the monorail may comprise merely a flat plate configuration with contact means engaging either the facing surfaces or the edges of the structure. Other modifications will be apparent to persons skilled in the art, but the invention is limited only by the claims hereinafter set forth.

I claim:

1. A portable bowling alley accessory for blind bowlers which enables them to properly position themselves to address and to approach an alley for delivering a bowled ball comprising (a) a monorail which can be disposed to extend linearly horizontal, (b) a traversable carriage removably engagable with said monorail wherein said carriage is configured with contact means bearing against at least one upper facing surface and at least one lower facing surface of said monorail and further is configured with a handle for being operably grasped by a bowler with his free hand while he is in the process of addressing an alley and bowling a ball, and further wherein said monorail comprises elongated sections arranged to be end abutting and connected by hinge means which fold oppositely one from the other at the ends of any said sections.

2. The accessory of claim 1 wherein said contact means comprise rollers.

3. The accessory of claim 1 wherein said monorail is configured with laterally extending flanges at its upper extremity.

4. The accessory of claim 1 wherein said monorail is configured with recesses for receiving therein bowling balls as weighting means.

5. The accessory of claim 1 wherein said handle is manually detachable from said carriage.

6. The accessory of claim 1 wherein said carriage is disengaged from said monorail by being traversed beyond an end extremity of any sectional portion thereof.

* * * * *